US005915564A

United States Patent [19]

Hsi-Chang

[11] Patent Number: 5,915,564

[45] Date of Patent: Jun. 29, 1999

[54] FOLDED CARDBOARD ARTICLE FOR PACKAGING SPURS

[75] Inventor: Chang Hsi-Chang, Taichung, Taiwan

[73] Assignee: Eastwest International (Taiwan) Enterprises, Taichung, Taiwan

[21] Appl. No.: 08/946,388

[22] Filed: Oct. 7, 1997

[51] Int. Cl.[6] ..... B65D 85/18

[52] U.S. Cl. ..... 206/784; 206/299; 206/482

[58] Field of Search ..... 206/278, 299, 206/784, 806, 477, 482, 487, 223, 577, 225

[56] References Cited

U.S. PATENT DOCUMENTS

| | | | |
|---|---|---|---|
| 2,949,185 | 8/1960 | Foote et al. | 206/477 |
| 4,700,833 | 10/1987 | Smith | 206/63.3 |
| 5,375,717 | 12/1994 | Roshdy | 206/477 |
| 5,392,919 | 2/1995 | Passamoni | 206/577 |

*Primary Examiner*—Paul T. Sewell
*Assistant Examiner*—Nhan T. Lan
*Attorney, Agent, or Firm*—Antonio R. Durando

[57] ABSTRACT

A single-piece cardboard sheet into which slots and tabs are strategically cut to permit its folding into a carton for packaging a spur. The top section of the unfolded cardboard carton contains a cutout and an elongated tab projecting upwards; the end of the tab consists of a distal foldable flap separated from the tab by two lateral indentations. The central section of the carton contains a hanging slot suitable for receiving a hook of a display rack and two lower vertical slots spaced apart a distance commensurate with the size of the spur. In addition, a partial cut in the area above and around the upper slot defines a boundary between the upper and central sections of the carton such that the hanging slot is unencumbered when the two sections are folded. Finally, a horizontal slit sized to receive the tab is cut above and between the two vertical slots, the exact position being selected to meet the tab when the upper section of the carton is folded over the central section. The bottom section of the cardboard carton contains a horizontal opening sufficiently large to receive the tab and including a lower narrower part only wide enough to match the indentations in the tab, such that the flap can be bent over and provide a fastening mechanism for the entire structure when the section is also folded to complete the packaging assembly.

20 Claims, 6 Drawing Sheets

FOLDED CARDBOARD ARTICLE FOR PACKAGING SPURS

BACKGROUND OF THE INVENTION

1. Field of the Invention

This invention is related in general to the field of packaging and displaying of commercial articles. In particular, the invention consists of a novel cardboard carton for packaging and displaying riding spurs.

2. Description of the Related Art

For marketing purposes, it is desirable to package products such that they are visible and easily placed on a shelf, preferably hanging from a display hook. In addition, it is desirable to package them in a relatively inexpensive container or carton. In the case of riding spurs, it is also necessary that the packaging allow a potential buyer the opportunity to touch and feel the spurs, and try them on the footwear for which they are intended. Accordingly, it is important that the package be suitable for easy opening and removal of the spur, and further for easy reassembly into an undamaged package.

Products are often packaged in folded cardboard structures especially designed for the task at hand. Typically, the carton is produced by shaping a flat cardboard sheet to fit the dimensions of the article to be packaged and by cutting appropriate tabs and slots to form the carton around the article. The present invention relates to a novel cardboard structure for packaging spurs.

A spur is a pointed device secured to a rider's boot heel to urge on a horse. Typically, spurs have a U-shaped configuration consisting of a curved portion with substantially straight ends, for mounting on the heel of a boot, and a point protruding outwardly from the curved portion. As a result of their geometry, spurs are not conveniently suitable for hanging on a display rack. Thus, they are usually displayed in plastic bags or loosely on a rack.

Therefore, it would be desirable to have an inexpensive and practical packaging cardboard structure for visibly containing and displaying a spur on a shelf. This invention is directed at a simple device for achieving that purpose.

BRIEF SUMMARY OF THE INVENTION

One primary goal of this invention is a cardboard structure for packaging a spur for display on a rack.

Another goal of the invention is a packaging structure that is folded around a spur to form a package suitable for display.

Another objective is a package that can be assembled around a spur simply and quickly.

Finally, an objective of the invention is a device that is inexpensively manufactured from material readily available in commerce, preferably cardboard.

Therefore, according to these and other objectives, the present invention consists of a piece of cardboard sheet or equivalent material into which slots and tabs are strategically cut to permit its folding into a carton for packaging a spur. The top section of the unfolded cardboard carton contains a trapezoidal cutout and an elongated tab projecting upwards; the end of the tab consists of a distal foldable flap separated from the tab by two lateral indentations. The central section of the carton contains a hanging slot suitable for receiving a hook of a display rack and two lower vertical slots spaced apart a distance commensurate with the size of the spur. In addition, a partial cut in the area above and around the upper slot defines a boundary between the upper and central sections of the carton such that the hanging slot is unencumbered when the two sections are folded. Finally, a horizontal slit sized to receive the tab is cut above and between the two vertical slots, the exact position being selected to meet the tab when the upper section of the carton is folded over the central section. The bottom section of the cardboard carton contains a horizontal opening sufficiently large to receive the tab and including a lower narrower part only wide enough to match the indentations in the tab, such that the flap can be bent over and provide a fastening mechanism for the entire structure when the section is also folded to complete the packaging assembly.

The spur is packaged by placing its ends through the vertical slots facing the back side of the structure; folding the bottom section of the cardboard carton backwards to support the spur ends; folding the top section forward and inserting the tab through both the horizontal slit in the central section and the opening in the bottom section; and bending the flap in the tab so that its indentations latch on to the narrower portion of the opening. The resulting assembly is a spur firmly packaged in a cardboard carton for shipment and display.

A spur packaged according to the invention is visible (FIG. 2), is accessible for touching while still within the package, and is easily removable from the carton to see whether it fits a buyer's footwear. Once taken apart, the carton can be reused to repackage the spur easily and without damage, if necessary.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose but one of the various ways in which the invention may be practiced.

DESCRIPTION OF THE PREFERRED EMBODIMENTS OF THE INVENTION

This invention is based on the idea of utilizing a single-piece cardboard segment to produce a foldable carton suitable for advantageously packaging and displaying a spur. The design of the cardboard article makes it possible to encase the spur and the straps normally sold with a spur in a single package simply by folding the article's top and bottom sections over the front and back, respectively, of the central section and using a tab and cooperating slot to latch all sections into an assembled package.

Figure 1:
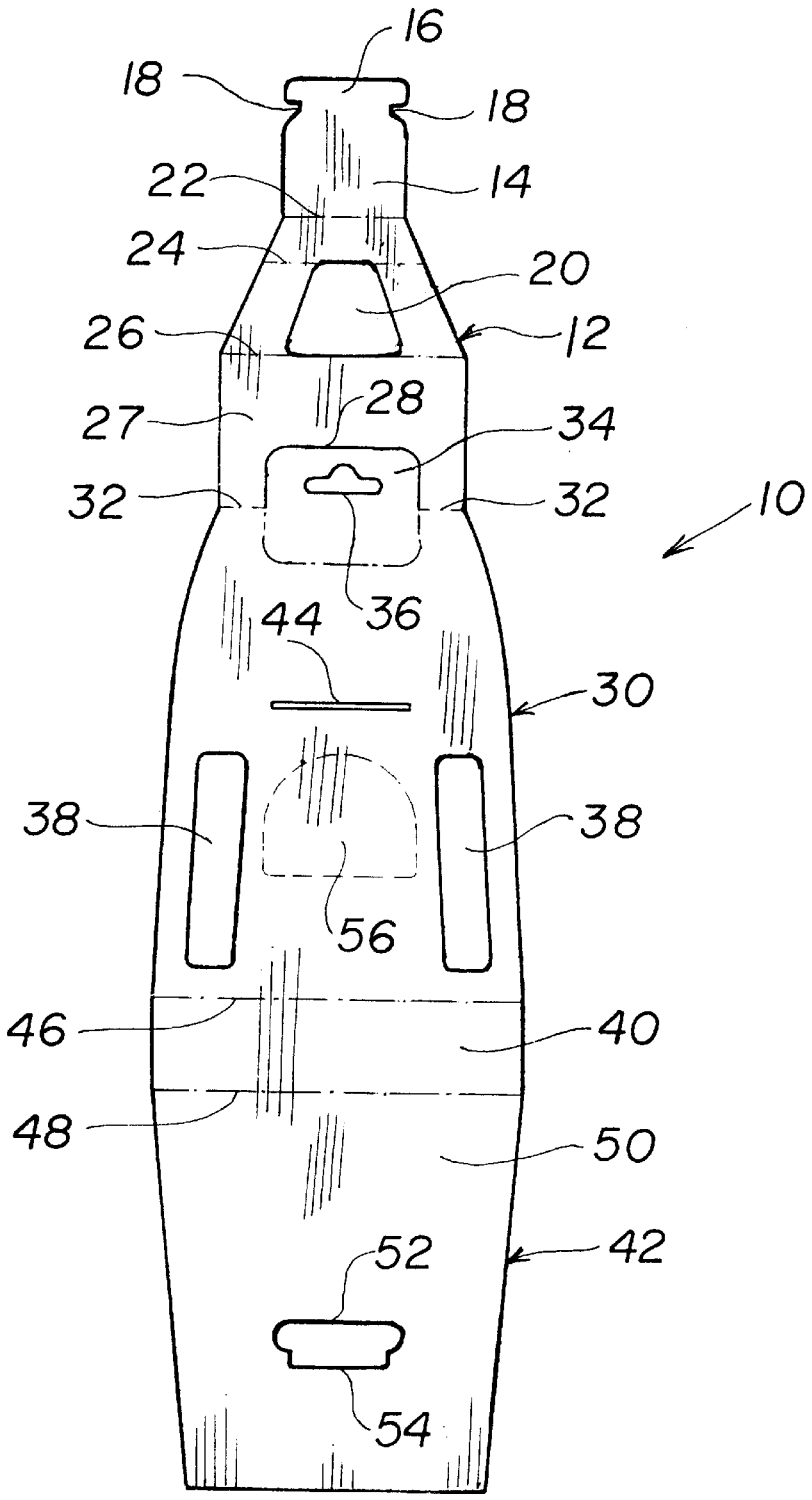
FIG. 1 is a plan view of a flat cardboard sheet cut to obtain a foldable packaging carton according to the preferred embodiment of the invention.

Referring to the figures, wherein like parts are designated by like reference numerals and symbols, FIG. 1 is a plan view of an unfolded cardboard packaging article or carton 10 according to the invention. The carton comprises three distinct sections that are folded to wrap around a spur and attendant straps packaged for distribution. The top section 12 of the article 10 includes an elongated tab 14 projecting upward along the length of the carton. The tip of the tab 14 consists of a flap 16 separated from the rest of the tab by two lateral indentations 18. A substantially trapezoidal cutout 20 is provided in the middle part of the section; as detailed below, the purpose of this cutout is to permit the protrusion therethrough of the point of the spur packaged within the carton. Therefore, the specific shape of the cutout 20 is not critical so long as adequate to allow passage of the point P of the spur S through it for retention and display, as illustrated in the assembled package view of FIG. 2. First, second and third fold lines 22, 24 and 26, respectively, are provided for forming the top section 12 into a retaining structure during the process of packaging the spur, as described below. The boundary of the lower part 27 of the top section 12 is defined by a partial cut 28 that separates it from the central section 30 of the article.

Figure 2:
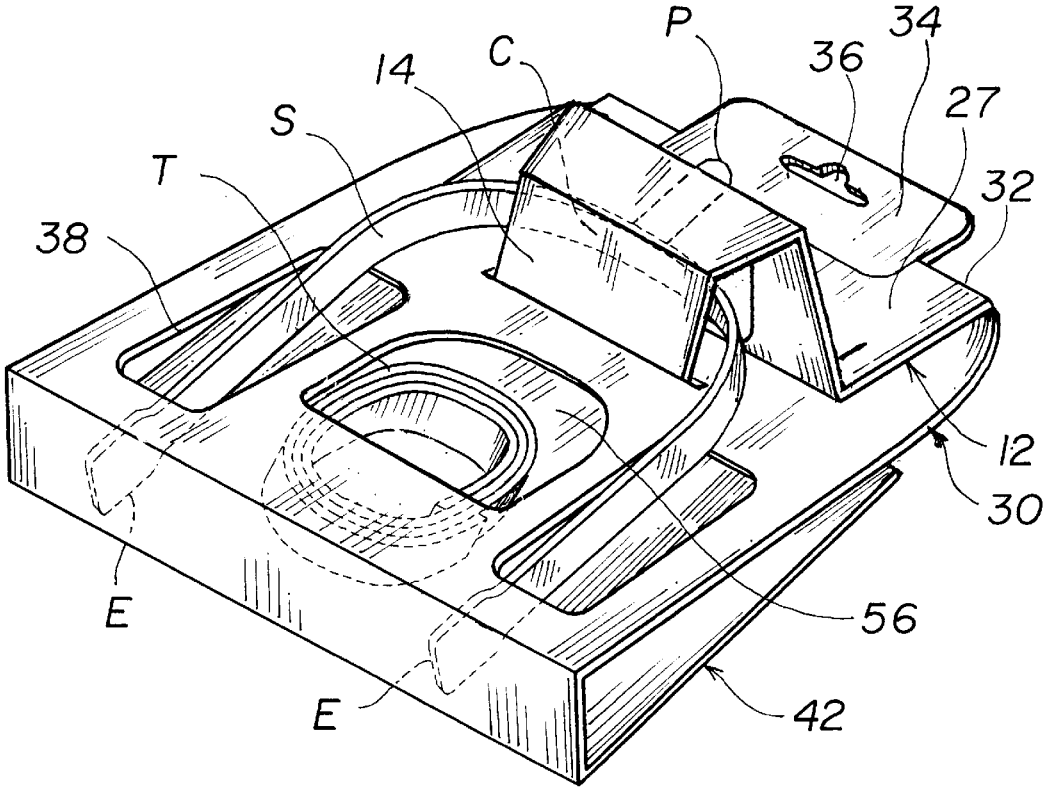
FIG. 2 is a perspective view of the carton of the invention after folding around a spur and straps to produce a packaged product.

The partial cut 28 and fold lines 32 contiguous to its ends constitute the upper boundary of the central section 30 of the packaging carton 10 and define an area 34 that protrudes into the lower portion 27 of the top section 12. Contained within the area 34 is a hanging slot 36 suitable for connection with a hook or other engaging member typically found in a display rack. The slot 36 is positioned within the area 34 such that it clears the top section 12 after the section is folded downward to form the package (as seen in FIG. 2) and becomes available for engagement by such a hook.

The central section 30 also contains two substantially parallel vertical slots 38 symmetrically disposed and spaced apart a distance equal to the width of the spur S for which the packaging article is intended. During the packaging process, the ends E of the spur are passed through the slots 38 from the front side toward the back such that they rest against the floor portion 40 of the bottom section 42 of the carton when the portion 40 is folded backwards (see FIG. 2). The remainder of the spur is placed on the front side of the central section 30; therefore, the width, length and position of the slots 38 are chosen so as to substantially match the size and shape of the spur S to be packaged. A horizontal slit 44 is also cut into the central section 30 between and above, or toward the top, of the slots 38. The function of the slit 44 is to allow the passage of the tab 14 through the central section 30 toward the back of the carton and over the curved portion C of the spur S (FIG. 2) when the top section 14 is folded as explained below. Therefore, the slit 44 must be at least as wide as the tab 14 (and its flap 16) and its longitudinal position is chosen to match the size of the spur, so that the tab 14 overlaps the curved portion C of the spur when its ends E butt against the folded floor portion 40 of the bottom section 42.

The fold line 46 defines the boundary between the central and bottom sections 30 and 42, respectively. A last fold line 48 separates the floor portion 40 from the back portion 50 of the bottom section 42. During packaging, the bottom section 42 is folded backwards to form a support floor for the spur and a backing for the resulting package. A latch slot 52 is provided in the bottom section 42 for receiving and latching the tab 14 protruding from the back of the carton after the tab is threaded through the slit 44. Accordingly, the slot 52 consists of a horizontal opening sufficiently wide to receive the tab 14, but also comprising a narrower bottom portion 54 only as wide as the distance between the indentations 18 in the tab 14, such that the tab can be latched by folding the flap 14 and engaging the indentations 18 with the lower portion 54 of the slot 52.

Figure 3:
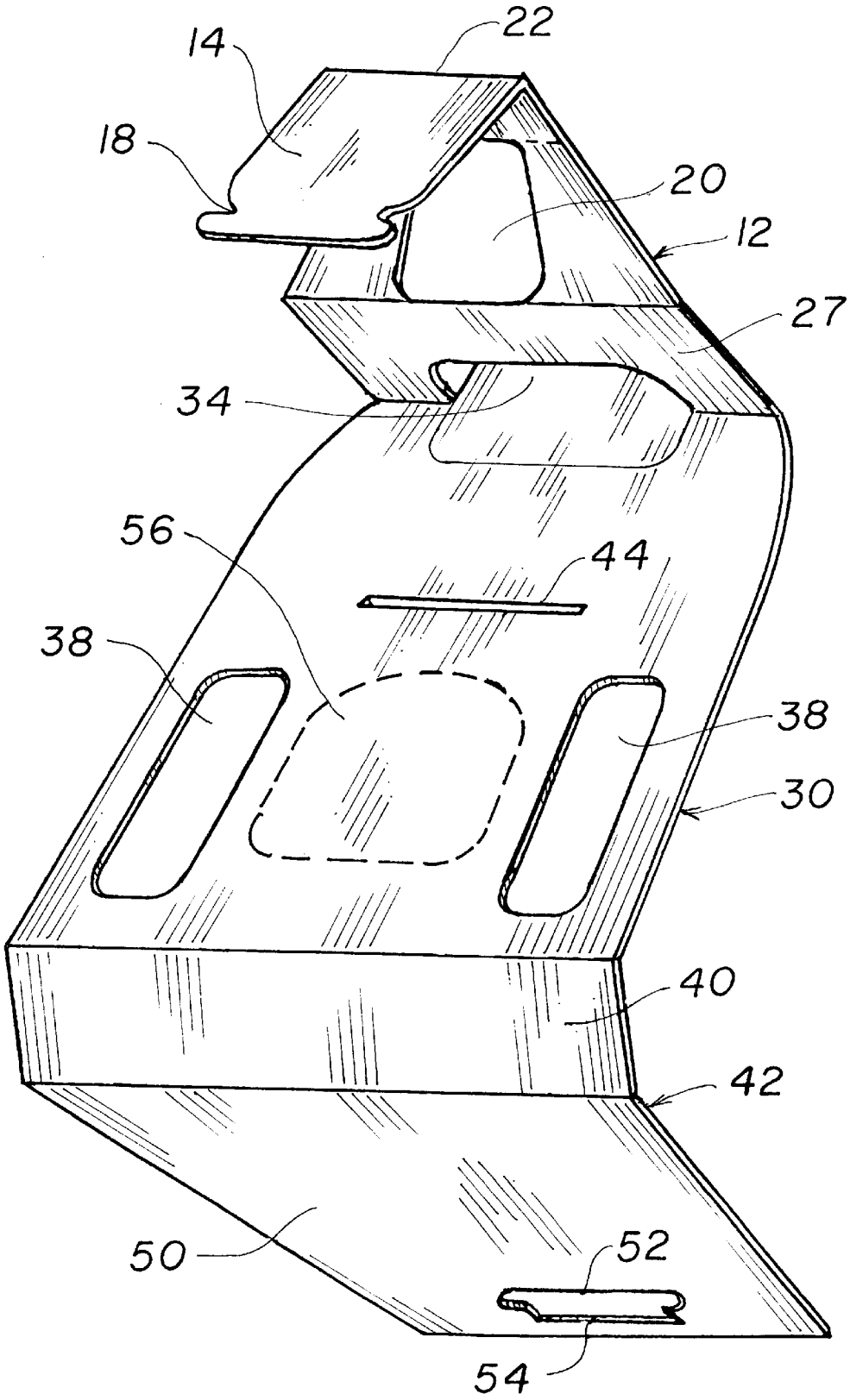
FIG. 3 is a perspective view of the carton of the invention illustrating the initial steps of folding the top section towards the front and the bottom section toward the back of the carton.
Figure 4:
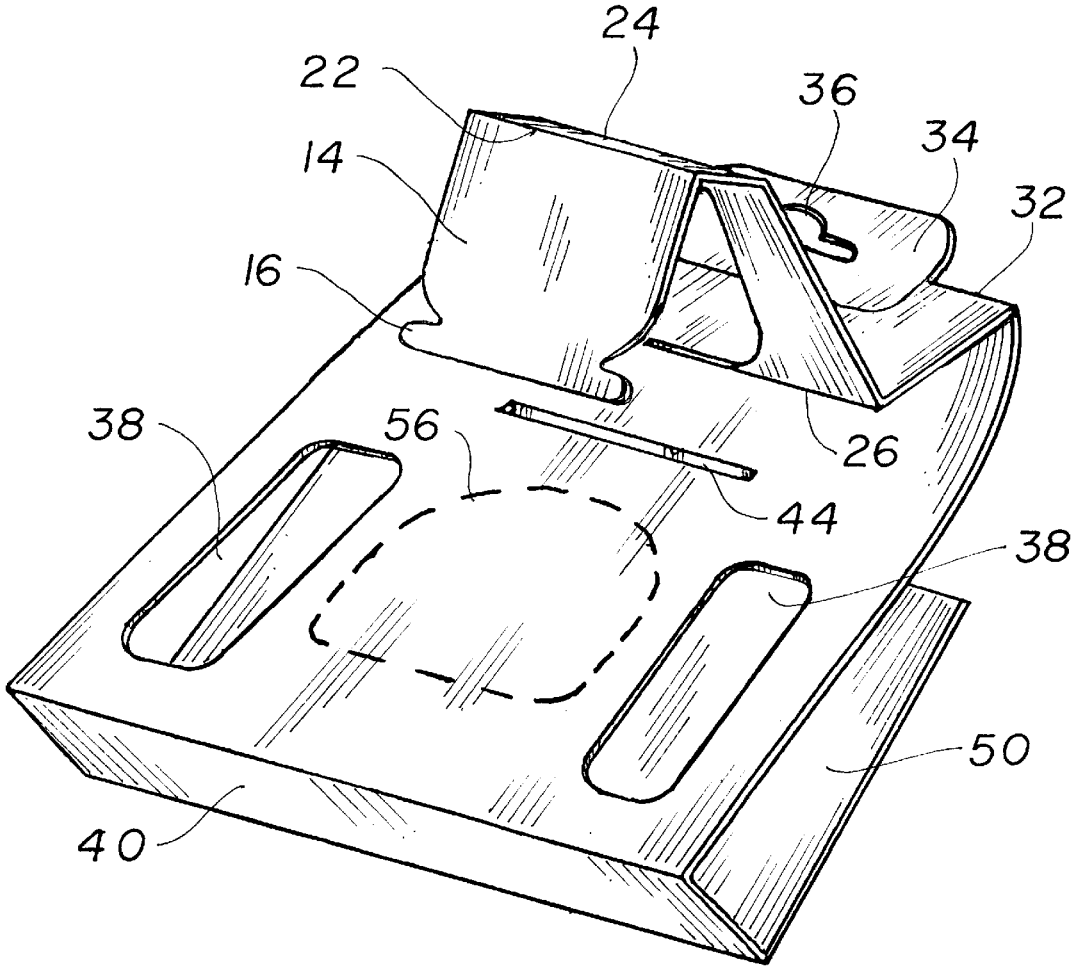
FIG. 4 illustrates secondary steps of folding the top and bottom sections of the carton prior to packaging of a spur.

Following is a description of how the packaging carton 10 of the invention is wrapped around a spur S to form a packaged item. As illustrated in FIGS. 3 and 4, the top section 12 is first folded all the way (180 degrees) towards the front of the carton along fold lines 32 to cause its lower part 27 to butt against the front of the central section 30. The top section 12 is then folded outward (90 degrees) along fold line 26 and inward again along fold lines 24 and 22 (90 degrees each) so as to bring the flap 16 facing the horizontal slit 44. Once so folded, the tab 14 provides a means for advantageously strapping the curved portion C of a spur S within the package while its point P protrudes from the cutout 20. The bottom section 42 of the carton 10 is similarly folded backwards along fold lines 46 and 48 (about 90 degrees each), whereby the floor and back portions 40 and 50 of the bottom section 42 form a floor and a back, respectively, for the package.

Figure 5:
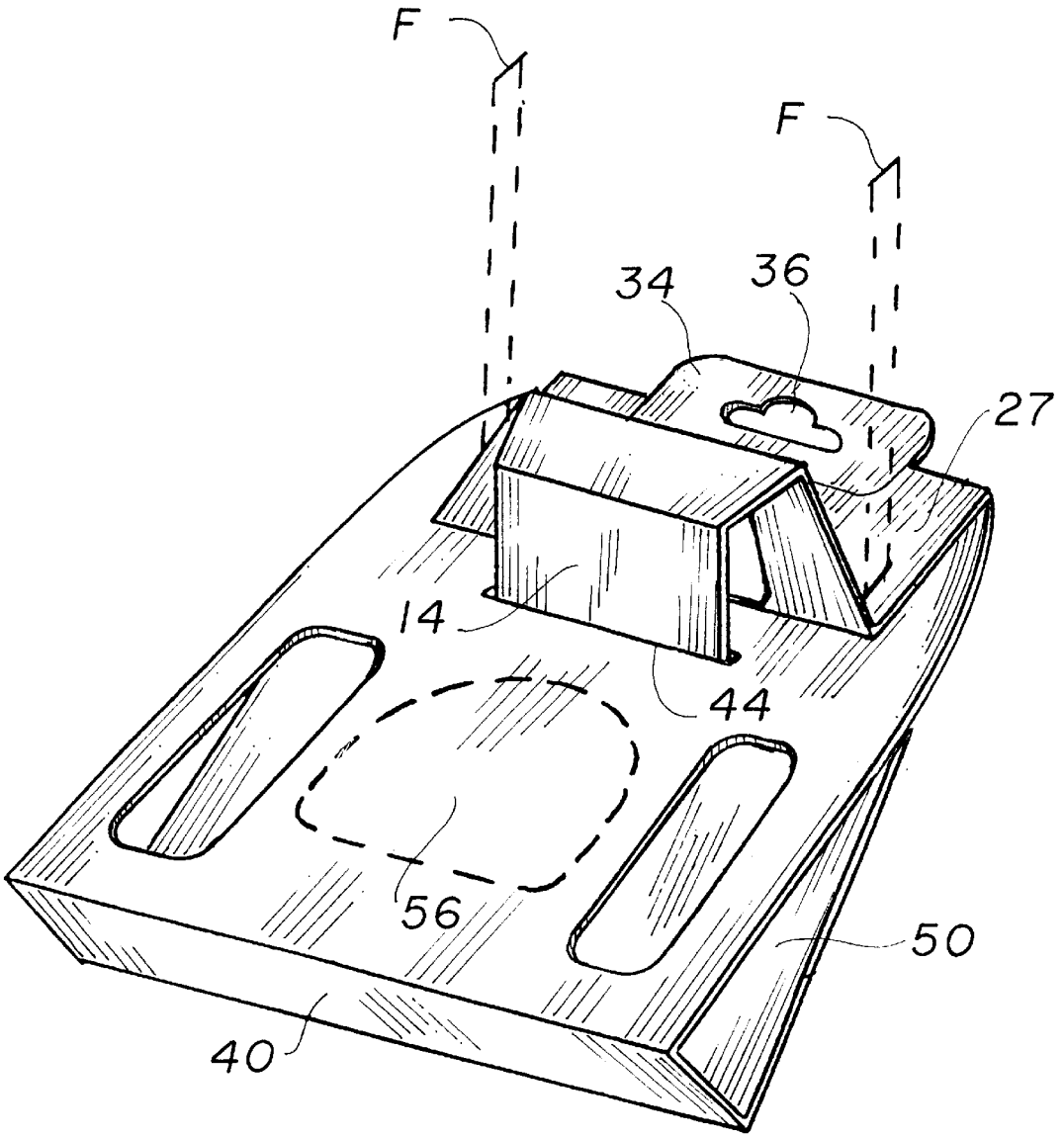
FIG. 5 illustrates the passage of the tab through the slit in the central section of the carton as performed during packaging to wrap around and retain the curved portion of the spur (the spur is not shown in the figure).
Figure 6:
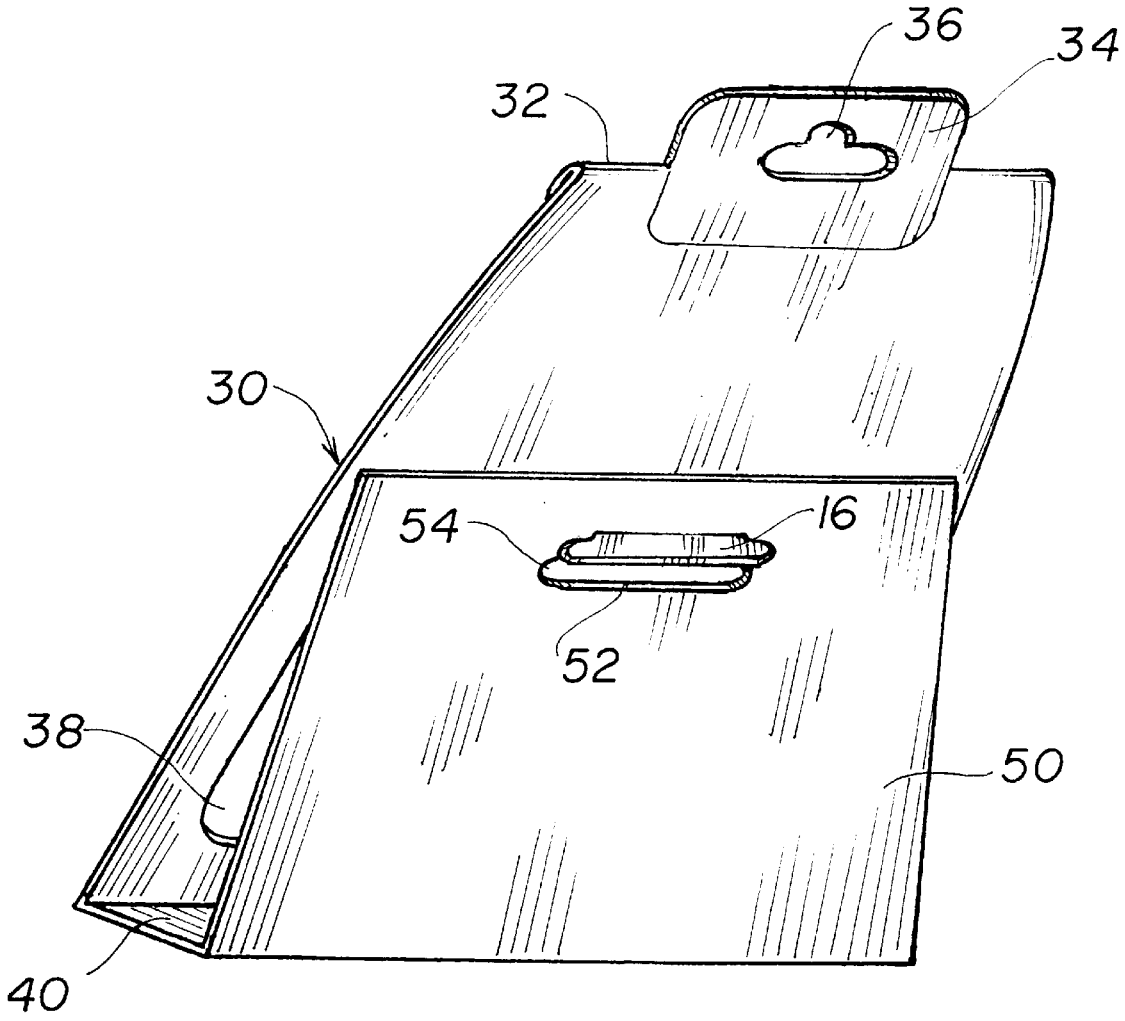
FIG. 6 is a back perspective view illustrating the folding of the flap in the tab to latch the opening in the bottom section of the carton.

After the spur S is placed on the central section 30 with its point P passed through the cutout 20 and its ends E through the vertical slots 38 (FIG. 2), the tab 14 is threaded through the horizontal slit 44 in the central section 30 and the latch slot 52 in the bottom section 42. As illustrated in FIGS. 5 and 6, the flap 16 is then folded upward to latch the slot 52 and provide a secure retaining anchor for the carton 10 assembled around the spur S. The enclosure so provided by the folded bottom section 42 around the spur S can be used also to contain straps T (FIG. 2) that may accompany the spur S in the package. If desired, an additional opening 56 may be cut into the central section of the article to render the straps T visible in the package.

It is clear that the specific design of the packaging carton 10 must be tailored to the dimensions of the spur S for which it is intended. Thus, the placement of the horizontal slit 44 and the lower slot 52 must be at approximately the same distance from the floor portion 40 of the bottom section 42, such that the tab 14 can easily be passed through both openings and the flap 16 can be folded to engage the narrower portion 54 of the slot 52 without bending the material out of shape. The distance between the slit 44 and the floor portion 40 also needs to be suitable for accommodating the spur S with the tab 14 folded over it. Similarly, the space between the tab 14 and the cutout 20 after assembly must not be so wide that the ends E of the spur can slide out of the vertical slots 38. That is, the distance between the cutout 20 and the floor portion 40 when the carton is folded should be approximately equal to the height of the U-shaped portion of the spur S.

In order to strengthen the package, it is desirable to attach the lower part 27 of the section 12 to the central section 30 against which it abuts either by gluing or stapling the two together, as illustrated in FIG. 5 with staples F. The resulting package, seen in FIG. 2, consists of a spur and straps securely and visibly contained within a carton that can be hung on a display rack through the slot 36. Although loosely held, it is apparent that the spur S cannot be removed from the carton without first unlatching the flap 16 from the slot 52 in the back of the package and unfolding the tab 14 to free the curved portion of the spur S.

In the preferred embodiment of the invention, found to be suitable for many commercial spurs, the carton 10 is approximately 47 cm long and 12 cm wide at the floor section 40, its widest point. The tab 14 is about 4.5 cm long and 4 cm wide, including a 0.7 cm long flap 16 and indentations about 3 cm apart. Approximately 1.5 cm separate fold lines 22 and 24; about 3.5 cm separate fold line 24 from fold line 26; about 5 cm separate fold line 26 from fold lines 32; and the slit 44 is about 4.5 cm long and positioned approximately 6 cm below the fold lines 32. As a result of these dimensions, the tab 14 protrudes about 1 cm from the back of the slit 44 when the top section 12 of the carton is folded in place. The vertical slots 38 are about 7 cm long, 1.5 cm wide, and positioned at least 1 cm from the fold line 46. The slots 30 are about 7 cm apart at the bottom and 6 cm at the top, generally in line with the convergence of the ends E of the spur S toward the curved portion C. The length of the central section 30, the distance between fold lines 32 and 46, is about 16 cm. The floor portion 40 of the bottom section 42 is about 3 cm long (corresponding to the distance between fold lines 46 and 48), and the back portion 50 is about 13.5 cm long. Finally, the narrower portion 54 of the slot 52 is approximately 3 cm wide and positioned about 9 cm from the fold line 48.

Various changes in the details, steps and components that have been described may be made by those skilled in the art within the principles and scope of the invention herein illustrated and defined in the appended claims. For example, material other than cardboard could readily be used so long as sufficiently rigid to provide support to the carton and suitable for bending along designated fold lines.

Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. A foldable carton for packaging a spur having a point protruding from a substantially U-shaped structure with spaced-apart ends, the carton comprising:

a top section including an elongated tab projecting therefrom;

a central section including a slit for receiving said elongated tab folded over a front side of the carton and two slots for receiving the ends of the spur; and a bottom section including a latch slot for engaging said elongated tab after the tab has been passed through the slit to a backside of the carton.

2. The carton of claim 1, further including a hanging slot in the central section for receiving a hook of a display rack.

3. The carton of claim 1, wherein said top, central and bottom sections consist of an integral piece of material.

4. The carton of claim 3, wherein said material is cardboard.

5. A foldable carton for packaging a spur having a point protruding from a substantially U-shaped structure with spaced-apart ends, the carton comprising:

a top section including an elongated tab projecting therefrom;

a central section including a slit for receiving said elongated tab folded over a front side of the carton and two slots for receiving the ends of the spur;

a bottom section including a latch slot for engaging said elongated tab after the tab has been passed through the slit to a backside of the carton; and a partial cut between said top and central sections to define a hanging region within the central section extending outwardly into the top section.

6. The carton of claim 5, further including a cutout in the top section for receiving the point of the spur.

7. The carton of claim 5, wherein said hanging region contains a hanging slot for receiving a hook of a display rack.

8. The carton of claim 5, wherein said elongated tab includes a distal flap defined by two indentations in the tab and said latch slot includes a portion adapted for engagement with said flap.

9. The carton of claim 5, wherein a portion of the top section is folded over the central section and attached to it.

10. The carton of claim 5, further including a cutout in the top section for receiving the point of the spur, and including a hanging slot in the hanging region for receiving a hook of a display rack; and wherein the elongated tab includes a distal flap defined by two indentations in the tab and said latch slot includes a portion adapted for engagement with said flap, a portion of the top section is folded over the central section and attached to it, and the carton consists of an integral piece of cardboard material.

11. The carton of claim 5, wherein said top, central and bottom sections consist of an integral piece of material.

12. A method of packaging a spur in a foldable carton, where the spur has a point protruding from a substantially U-shaped structure with spaced-apart ends, comprising the following steps:

(a) providing a foldable carton comprising:

a top section including an elongated tab projecting therefrom;

a central section including a slit for receiving said elongated tab and two substantially parallel slots for receiving the ends of the spur; and a bottom section including a latch slot for engaging said elongated tab;

(b) placing the ends of the spur through the parallel slots toward a backside of the carton;

(c) folding the top section forward such that the elongated tab wraps around the U-shaped structure of the spur;

(d) inserting the elongated tab through the slit in the central section to the backside of the carton;

(d) folding the bottom section backwards and engaging the elongated tab in the backside of the carton with the latch slot.

13. The method of claim 12, further comprising the steps of:

including a cutout in the top section for receiving the point of the spur; and placing the point of the spur through the cutout while carrying out step (c).

14. The method of claim 12, further comprising the steps of:

including a hanging slot in the central section for receiving a hook of a display rack.

15. The method of claim 12, further comprising the steps of:

including a partial cut between said top and central sections to define a hanging region within the central section extending outwardly into the top section; and including a hanging slot in said hanging region for receiving a hook of a display rack.

16. The method of claim 12, further comprising the steps of:

providing said elongated tab with a distal flap defined by two indentations in the tab; and providing said latch slot with a portion adapted for engagement with said flap.

17. The method of claim 12, further comprising the steps of:

folding and attaching a portion of the top section over the central section.

18. The method of claim 12, wherein said top, central and bottom sections used in step (a) consist of an integral piece of material.

19. The method of claim 18, wherein said material is cardboard.

20. The method of claim 12, further comprising the steps of:

including a cutout in the top section for receiving the point of the spur and placing the point of the spur through the cutout while carrying out step (c);

including a partial cut between said top and central sections to define a hanging region within the central section extending outwardly into the top section;

including a hanging slot in said hanging region for receiving a hook of a display rack;

providing said elongated tab with a distal flap defined by two indentations in the tab;

providing said latch slot with a portion adapted for engagement with said flap; and folding and attaching a portion of the top section over the central section;

wherein said top, central and bottom sections used in step (a) consist of an integral piece of cardboard material.

* * * * *